United States Patent [19]

Ohta et al.

[11] Patent Number: 4,729,718

[45] Date of Patent: Mar. 8, 1988

[54] WOBBLE PLATE TYPE COMPRESSOR

[75] Inventors: Masaki Ohta; Shinichi Suzuki; Akihiko Hyodo; Kenji Takenaka, all of Kariya, Japan

[73] Assignee: Kabushiki Kaisha Toyoda Jidoshokki Seisakusho, Aichi, Japan

[21] Appl. No.: 910,944

[22] Filed: Sep. 24, 1986

[30] Foreign Application Priority Data

Oct. 2, 1985 [JP] Japan ..... 60-219808

[51] Int. Cl.[4] ..... F04B 1/26

[52] U.S. Cl. ..... 417/222; 417/270

[58] Field of Search ..... 417/222, 270

[56] References Cited

U.S. PATENT DOCUMENTS

| | | | |
|---|---|---|---|
| 2,964,234 | 12/1960 | Loomis | 74/831 |
| 3,861,829 | 1/1975 | Roberts et al. | 417/270 X |
| 4,037,993 | 7/1977 | Roberts | 417/222 |
| 4,061,443 | 12/1977 | Black et al. | 417/222 |
| 4,145,163 | 3/1979 | Fogelberg et al. | 417/222 |
| 4,174,191 | 11/1979 | Roberts | 417/222 |
| 4,178,135 | 12/1979 | Roberts | 417/222 |
| 4,428,718 | 1/1984 | Skinner | 417/222 |
| 4,475,871 | 10/1984 | Roberts | 417/222 |
| 4,553,905 | 11/1985 | Swain et al. | 417/222 |
| 4,586,874 | 5/1986 | Hiraga et al. | 417/222 |
| 4,632,640 | 12/1986 | Terauchi | 417/222 X |

FOREIGN PATENT DOCUMENTS

| | | | |
|---|---|---|---|
| 60-175782 | 9/1985 | Japan | 417/222 |

OTHER PUBLICATIONS

"A Variable Piston-Stroke Mechanism for Gases", Biermann, 11/21/69, p. 5, lines 10 to 9 from the bottom, p. 6, lines 12 to 15.

*Primary Examiner*—Carlton R. Croyle
*Assistant Examiner*—Paul F. Neils
*Attorney, Agent, or Firm*—Burgess, Ryan and Wayne

[57] ABSTRACT

The inclination angle of the wobble plate in a wobble plate type compressor is changed to obtain a discharge capacity in accordance with a cooling load. A spring is provided to adjust the inclination angle of the wobble plate in cooperation with the pressure force acting upon the pistons connected to the wobble plate, and thus the pressure in the suction chamber corresponding to the temperature of the exhausted air is kept at a constant level. That is, the temperature of the exhausted air is kept at a constant level suitable for maintaining a desired cooling condition in a vehicle.

2 Claims, 5 Drawing Figures

WOBBLE PLATE TYPE COMPRESSOR

CROSS-REFERENCE TO RELATED APPLICATION

A copending U.S. patent application Ser. No. 812,247 filed on Dec. 23, 1985, now U.S. Pat. No. 4,687,419, owned by the same assignee as the application.

BACKGROUND OF THE INVENTION

1. Field of the Invention

The present invention relates to a continuously variable capacity type compressor. More particularly, the present invention relates to a wobble plate type compressor in which an inclination angle of the wobble plate is changed by a change in a differential level between a pressure in a crankcase interior and a pressure in a suction chamber, thereby automatically and continuously changing a discharge capacity under a condition wherein the pressure in the crankcase interior is kept at a predetermined level.

2. Description of the Related Art

In the wobble plate type compressor suitable for an air conditioning a vehicle, the inclination angle of the wobble plate is changed in accordance with the change of pressure in the suction chamber caused by a change in the cooling load in a vehicle, to change the refrigerant discharge capacity in accordance with the change in the cooling load in the vehicle. The pressure in the crankcase interior is kept at a predetermined level, and the wobble plate is inclined at a large inclination angle when the differential level between the pressure in the crankcase interior and the pressure in the suction chamber becomes low in response to a high cooling load in the vehicle, and is inclined at a small inclination angle when the differential level between the pressure in the crankcase interior and the pressure in the suction chamber becomes high in response to the low cooling load in the vehicle.

The inclination angle of the wobble plate is changed by a change in the pressure in the suction chamber. When the inclination angle is large, an operating distance is very small in a direction at a right angle to an axis of an drive shaft between the connecting pin and an end of a connecting rod for connecting the wobble plate with a piston. The piston is subjected to pressure in the crankcase interior and pressure in a discharge chamber at a compression stroke end (top dead center). Consequently, although there is a large differential level between the pressure in the crankcase interior and a pressure in the discharge chamber acting upon an under surface and a top surface of the piston, the moment value of the wobble plate in one direction about the connecting pin is very small. Thus, when this moment is in an equilibrium state, a differential level between the pressure in the crankcase interior and the pressure in the suction chamber acting upon an under surface and a top surface of another piston, which is at a suction stroke end (bottom dead center), is very small from the view point of moment equilibrium of the wobble plate. That is, the pressure in the suction chamber is substantially equal to the pressure in the crankcase interior.

When the inclination angle is small, the above-mentioned operating distance is much larger than the operating distance when the inclination angle is large. Thus, the moment about the connecting pin is in an equilibrium state when the pressure in the suction chamber is higher than the pressure in the crankcase interior, to oppose the differential pressure force between the pressure in the crankcase interior and the pressure in the discharge chamber, which force causes the moment of the wobble plate in the above mentioned one direction about the connecting pin.

As mentioned above, the pressure in the suction chamber becomes large in accordance with a decrease of the inclination angle of the wobble plate. A temperature of the air exhausted through an evaporator which absorbs heat from the air in the vehicle, has a relationship with the pressure in the suction chamber. Therefore, the temperature of the air exhausted through the evaporator becomes high in accordance with the decrease of the inclination angle of the wobble plate.

The rise in temperature of the air exhausted through the evaporator in accordance with the decrease of the inclination angle of the wobble plate is undesirable from the view point of the occupant of the vehicle, in particular when the temperature in a vehicle is changed suddenly by an external factor, such as by the effect of direct sunlight entering the vehicle when the compressor is operated in accordance with the low cooling load, the occupant of the vehicle becomes uncomfortable.

SUMMARY OF THE INVENTION

It is therefore an object of this invention to provide a wobble plate type compressor which can maintain a substantially constant pressure level in the suction chamber regardless of the inclination angle of the wobble plate.

In accordance with the object of the present invention, the wobble plate type compressor is provided with a spring which is forced against a wobble device in such a way that it opposes a decrease of the inclination angle of the wobble plate. This spring is a cylindrically coiled helical compression spring mounted on a drive shaft. The force of the compression spring opposes a differential pressure force between a pressure in a crankcase interior and a pressure in a discharge chamber, which force causes a moment of the wobble plate in one direction. As a result, the pressure in the suction chamber is substantially equal to the constant pressure level in the crankcase interior in the region where an inclination angle of the wobble plate is controlled.

If the force of the spring is too weak, the temperature of the air exhausted through the evaporator is high, and thus the occupant of the vehicle feels uncomfortably hot. On the other hand, if the force of the spring is too strong, the evaporator will frost-up. Therefore, in a preferred embodiment of the present invention, the spring is arranged so that the force against the wobble device of the spring is zero when the inclination angle of the wobble plate is at a largest value. As mentioned above, if the force of the spring is too strong, the pressure in the suction chamber is suppressed, that is, the evaporator becomes frosted-up. This problem is resolved by setting a predetermined constant pressure level in the crankcase interior to a larger value. In this case, however, the amount of discharged refrigerant gas returned from the discharge chamber to the suction chamber through the crankcase interior increases, and thus the performance of the wobble plate type compressor is degraded.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

Figure 5:
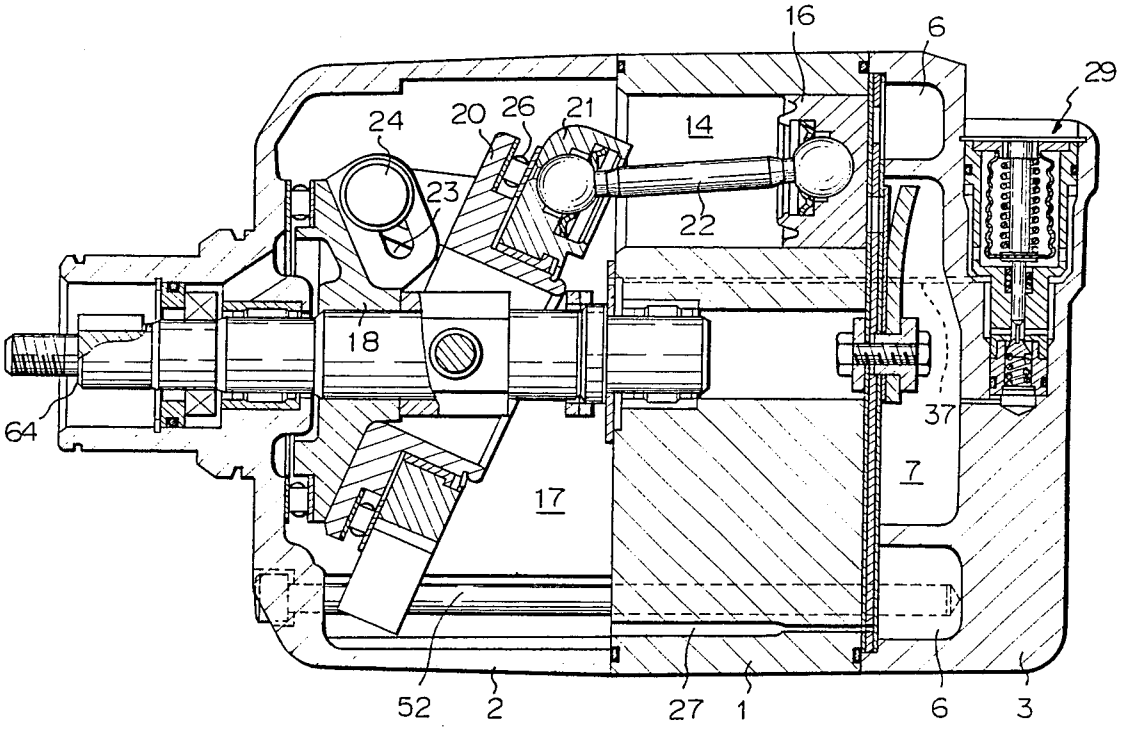
Fig. 5 (PRIOR ART)
FIG. 5 is a longitudinal cross-sectional view showing the wobble plate type compressor according to the prior art.

Referring to FIG. 5, a crankcase interior 17 surrounded by a crankcase 2 communicates with a suction chamber 6 through a first passageway 27, and with a discharge chamber 7 through a second passageway 37. A control device 29 is disposed in a rear housing 3 to control the opening or closing of the second passageway 37 in response to a change in the pressure in the crankcase interior 17, so that the pressure in the crankcase interior 17 is kept at a predetermined level. A plurality of cylinder bores 14 having pistons 16 are defined in a cylinder block 1. A rotary drive plate 20 is connected to a drive element 18 fixedly mounted on a drive shaft 64 through a connecting pin 24 engaged in a guide slot 23 defined on the drive element 18. Therefore, the rotary drive plate 20 is rotated by a rotation of the drive shaft 64. A wobble plate 21 is supported on the rotary drive plate 20 through thrust bearings 26 and a rod 52 so that the wobble plate 21 does not rotate but wobbles. The wobble plate 21 is connected with each piston 16 by connecting rods 22, respectively. Accordingly, an amount of the refrigerant gas discharged is changed in accordance with the angle of inclination of the wobble plate 21 and the rotary drive plate 20.

Figure 3:
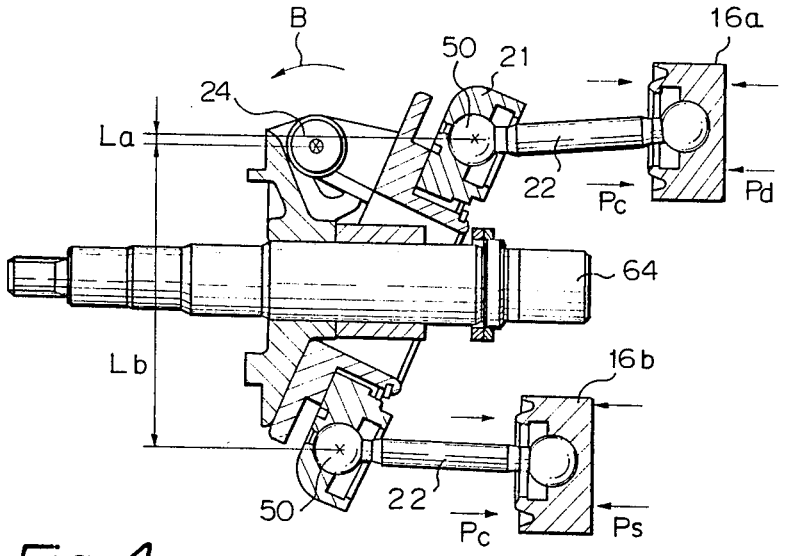
Fig. 3 (PRIOR ART)
FIG. 3 is a view of a moment equilibrium acting upon the wobble plate in the largest angle position of the wobble plate.
Figure 4:
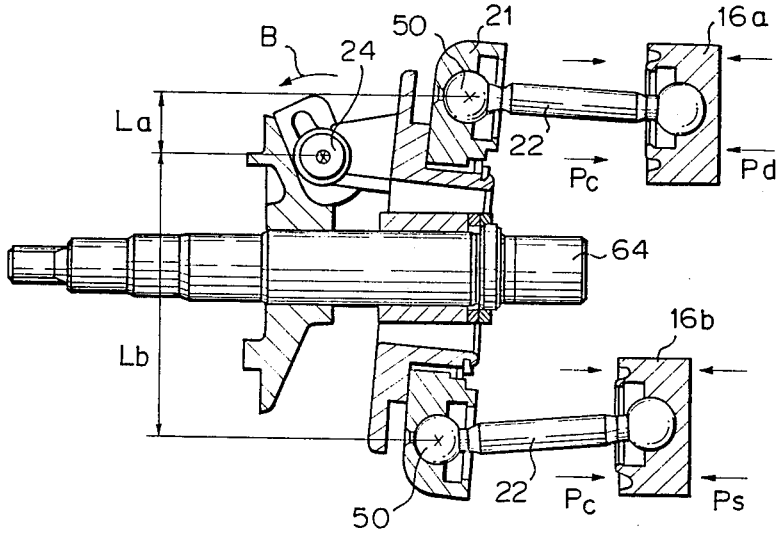
Fig. 4 (PRIOR ART)
FIG. 4 is a view of a moment equilibrium acting upon the wobble plate in the smallest angle position of the wobble plate.

Referring to FIGS. 3 and 4, the equilibrium of moment of the wobble plate 21 about the connecting pin 24 will be described hereinafter. FIG. 3 shows the state where the inclination angle of the wobble plate 21 is largest. The piston 16*a* is at the end of the compression stroke (top dead center), and the piston 16*b* is at the end of the suction stroke (bottom dead center). The differential pressure force between the pressure Pd in the discharge chamber and the pressure Pc in the crankcase interior acting upon the piston 16*a* is at a maximum value in the state shown in FIG. 3. Nevertheless, the moment of the wobble plate 21 in the direction of the arrow B about the connecting pin 24 is so small that it is negligible, since the operating distance La from the center of the connecting pin 24 to the center of the ball joint 50 of the connecting rod 22 is extremely small. Accordingly, although the other operating distance Lb from the center of the connecting pin 24 to the center of the ball joint 50 of the connecting rod 22 associated with the piston 16*b* is large, the total moment of the wobble plate 21 is kept in an equilibrium when the pressure Ps in the suction chamber is substantially equal to the pressure Pc in the crankcase interior from the view point of moment equilibrium of the wobble plate 21.

On the other hand, the operating distance La is larger when the inclination angle of the wobble plate 21 is small, as shown in FIG. 4. Therefore, the moment of the wobble plate 21 in the direction of the arrow B cannot be ignored, and accordingly, the total moment of the wobble plate 21 is equilibrated by the pressure Ps in the suction chamber, which is the pressure Pc plus the product of the differential pressure (Pd−Pc) and the ratio of the operating distance (La/Lb).

Figure 2:
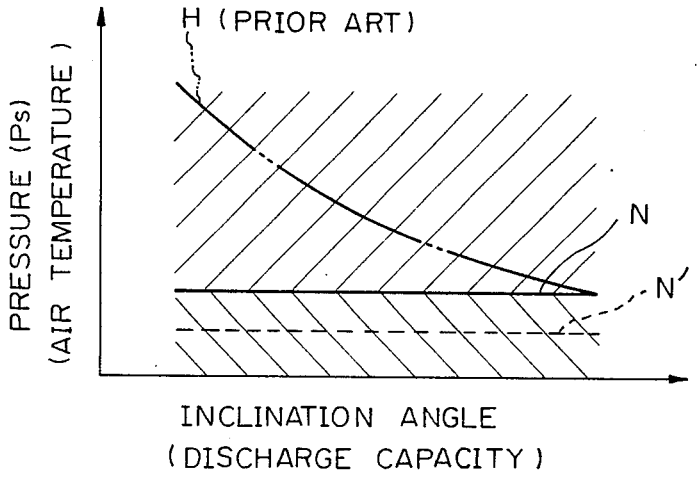
FIG. 2 is a graph illustrating the relationship of a pressure in a suction chamber to an inclination angle of the wobble plate.

The relationship of the pressure Ps in the suction chamber to the inclination angle of the wobble plate 21 by a dash-two-dot line H is shown in FIG. 2. The pressure Ps in the suction chamber represents the temperature of the air exhausted from an evaporator. Therefore, the line H shows a curve of the temperature of the air exhausted from the evaporator in accordance with the inclination angle of the wobble plate. The change in temperature of the air exhausted from the evaporator is extremely undesirable for an occupant of a vehicle.

It is, therefore, an object of this invention to maintain the pressure Ps in the suction chamber at a substantially constant level regardless of the inclination angle of the wobble plate 21.

Figure 1:
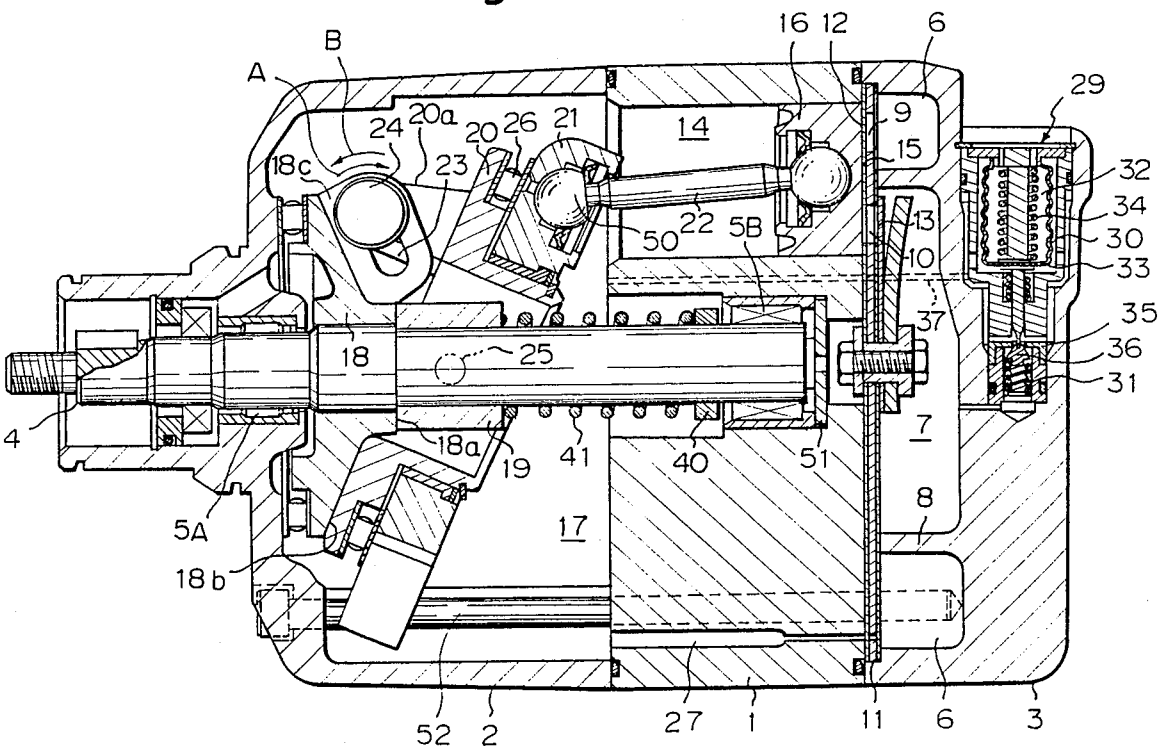
FIG. 1 is a longitudinal cross-sectional view showing a wobble plate type compressor according to the present invention.

In FIG. 1 showing the present invention, the same reference numerals are used as for the corresponding elements shown in FIGS. 3, 4, 5.

Referring to FIG. 1, a housing of a wobble plate type compressor is constituted by a cylinder block 1, a crankcase 2, and a rear housing 3. A bearing 5A for a drive shaft 4 is disposed in the center of the crankcase 2. A suction chamber 6 and a discharge chamber 7 are disposed in a concentric configuration in the rear housing 3 and separated from each other by an annular partition wall 8. The discharge chamber 7 for discharging a refrigerant after compression from a plurality of cylinder bores 14, which will be described later, is defined in the central portion of the rear housing 3, and the suction chambers 6 for drawing-in the refrigerant before compression to the plurality of cylinder bores 14 are defined around the periphery of the rear housing 3 so as to surround the discharge chamber 7. In detail, the suction chambers 6 and the discharge chamber 7 are communicated with associated compression chambers 15 in the plurality of cylinder bores 14 through associated intake ports 9 and associated discharge ports 10 disposed in a valve plate 11. An intake reed valve 12 is disposed at the intake port 9 and opens the intake port 9 in accordance with a suction stroke of a piston 16, which will be described later. A discharge reed valve 13 is disposed at the discharge port 10 and opens the discharge port 10 in accordance with a compression stroke of the piston 16.

Another bearing 5B for rotatively supporting the drive shaft 4 in cooperation with the aforesaid bearing 5A is disposed in the center of the cylinder block 1. A plurality of the cylinder bores 14 are defined around the periphery of the cylinder block 1 so as to surround the drive shaft 4, and a reciprocating piston 16 is disposed in each cylinder bore 14. A compression chamber 15 is defined between the piston 16 and the aforesaid valve plate 11 in each cylinder bore 14. Each compression chamber 15 is selectively communicated with a suction chamber 6 or the discharge chamber 7 through the intake port 9 or the discharge port 10 by the intake reed valve 12 or the discharge reed valve 13.

A crankcase interior 17 is defined in the crankcase 2. The crankcase interior 17 communicates with the plurality of cylinder bores 14. The aforesaid drive shaft 4 supported by the bearings 5A, 5B extends axially through the crankcase interior 17. A rear end of the drive shaft 4 is supported by a thrust washer 51. A drive element 18 is fixedly mounted at the front portion of the drive shaft 4, an end surface 18*a* being defined in the central portion of the drive element 18 to stop any movement in the forward direction along the drive shaft 4 by a sleeve 19, which will be described later. A plane surface 18*b* is defined on one portion at the periphery of the drive element 18, and a lug 18*c* is mounted at the opposite position to the plane surface 18*b* of the drive element 18, and is provided with an elongated and slanting guide slot 23. A rotary drive plate 20 is disposed obliquely through the drive shaft 4. A bracket 20*a* is fixed at the periphery of the front surface of the rotary drive plate 20. A laterally extending connecting pin 24 connected to the end of the bracket 20*a* is engaged in the elongated and slanting guide slot 23, so that the rotary drive plate 20 is rotated by the drive shaft 4. On the other hand, a sleeve 19 is slidably mounted on the drive shaft 4, and a pair of pivotal pins 25 are mounted on both sides of the sleeve 19. The rotary drive plate 20 is pivoted around the pair of pivotal pins 25. Therefore, a inclination angle of the rotary drive plate 20 can be changed in accordance with the position of the sleeve 19 along the drive shaft 4. A wobble plate 21 is mounted on the rotary drive plate 20 through a thrust bearing 26 and prevented from rotating by a rod 52. Therefore, the wobble plate 21 is wobbled in accordance with the rotation of the rotary drive plate 20.

The wobble plate 21 is connected to each piston 16 by associated connecting rods 22. Therefore, each piston 16 reaches a top dead center position when the lug 18*c* comes to a position facing each cylinder bore 14 during rotation.

A ring 40 is fixedly mounted at the rear of the drive shaft 4. A cylindrically coiled helical compression spring 41 is mounted along the drive shaft 4 between the sleeve 19 and the ring 40. The coil spring 41 biases the sleeve 19 forward along the drive shaft 4 by the biasing force corresponding to the compression ratio thereof, in accordance with the position of the sleeve 19 on the drive shaft 4, which position corresponds to the inclination angle of the wobble plate 21. Therefore the coil spring 41 opposes a differential pressure force between a pressure in the crankcase interior and a pressure in the discharge chamber, which act upon the piston 16 on the compression stroke. That is, the coil spring 41 opposes the force which operates the wobble plate 21 to decrease the inclination angle of the wobble plate 21 and the rotary drive plate 20. The inclination angle is measured from a plane at a right angle to an axis of the drive shaft 4. Preferably, the spring 41 is mounted such that the force of the spring 41 is zero when the inclination angle of the wobble plate 21 is largest. Note, the spring modulus of the spring 41 is selected in accordance with the maximum discharge capacity.

A first passageway 27 passes through the cylinder block 1 and the valve plate 11, thereby providing communication between the crankcase interior 17 and the suction chamber 6. A second passageway 37 passes through the cylinder block 1, the valve plate 11 and the rear housing 3, thereby providing communication between the crankcase interior 17 and the discharge chamber 7. In the rear housing 3, a control device 29 for controlling the opening and closing of the second passageway is provided. The pressure control in the crankcase interior 17 is carried out by an operation of the control device 29.

A pressure chamber 30 communicated with the crankcase interior 17 through the second passageway 37, and another pressure chamber 31 communicated with the discharge chamber 7 through the second passageway 37, face each other in the control device 29. A bellows 33, the interior 32 of which communicates with an outside atmosphere, is disposed in the pressure chamber 30. A coil spring 34 is mounted such that the spring 34 usually biases the bellows 33 in the extended position. A valve seat 35 is disposed to separate the pressure chamber 30 from the pressure chamber 31. A valve 36 connected to the bellows 33 is provided to close a hole of the valve seat 35, to cut communication between the crankcase interior 17 and the discharge chamber 7.

Hereinafter the operation of the above-mentioned wobble plate type compressor will be described. The pressure in the crankcase interior 17 and the pressure in the suction chamber 6 are usually at an equilibrium at a higher pressure level than a predetermined pressure level when the operation of the compressor is stopped. The predetermined pressure level is the sum of the pressure exerted by the atmospheric pressure and the force of the spring 34. Accordingly, the bellows 33 is contracted by the differential pressure force which is the pressure in the crankcase interior 17 minus the predetermined pressure level, and therefore, the second passageway 37 is closed by the valve 36.

When the driving force of a drive unit is transferred to the drive shaft 4 through a magnetic clutch when the compressor is stopped, the rotary drive plate 20 begins to rotate. When the rotary drive plate 20 begins to rotate, the pressure Ps in the suction chamber 6 temporarily suffers a sudden drop. That is, the differential pressure force between the pressure Pc in the crankcase interior 17 and the pressure Ps in the suction chamber 6, is generated. As a result, the rotary drive plate 20 rotates in the state wherein the inclination angle of the rotary drive plate 20 (the wobble plate 21) is small in accordance with the differential pressure force. That is, the piston 16 reciprocates with a short stroke in accordance with the wobbling of the wobble plate 21.

Subsequently, the refrigerant gas in the crankcase interior 17 gradually escapes into the suction chamber 6 through the first passageway 27 so that the differential pressure force is reduced. Therefore, the wobble plate 21 wobbles in the state wherein the inclination angle of the wobble plate 21 is large. That is, each piston 16 reciprocates with a long stroke so that the compressor is driven at maximum capacity.

When the compressor is driven at the maximum capacity, the air in the vehicle is gradually cooled down, and thus the pressure Ps in the suction chamber 6 drops in accordance with the decrease of the cooling load, and the pressure Pc in the crankcase interior 17 also drops, since the crankcase interior 17 communicates with the suction chamber 6 through the first passageway 27. As the pressure in the chamber 30 becomes equal to the pressure Pc in the crankcase interior 17, the bellows 33 extends and releases the valve 36 when the pressure Pc in the crankcase interior 17 drops below the predetermined pressure level, which is the atmospheric pressure plus the biasing force of the coil spring 34. As a result, the discharged refrigerant gas is supplied into the crankcase interior 17 through the second passageway 37, and thus the pressure Pc in the crankcase interior 17 is kept at the predetermined pressure level. When the pressure Ps in the suction chamber 6 drops further, while the pressure Pc in the crankcase interior 17 is kept at the predetermined pressure level, the wobble plate 21 with the rotary drive plate 20 is moved in the direction of the arrow B shown in FIG. 1 about the connecting pin 24. The inclination angle of the wobble plate 21 with the rotary drive plate 20 becomes small, and therefore, the discharge capacity of the refrigerant gas is decreased. When the pressure Ps in the suction chamber 6 rises in accordance with the decrease of the discharge capacity, the movement of the wobble plate 21 with the rotary drive plate 20 about the connecting pin 24 is equilibrated. The inclination angle of the wobble plate 21 becomes small for as long as a low cooling load state prevails. The minimum inclination angle of the wobble plate 21 is limited by the biasing force (or free length) of the coil spring 41.

When the cooling load is increased in accordance with the decrease of the discharge capacity of the refrigerant gas, the pressure Ps in the suction chamber rises so that the wobble plate 21 is moved in the direction of the arrow A shown in FIG. 1 about the connecting pin 24 in accordance with the differential pressure force between the pressure Ps and the predetermined pressure Pc in the crankcase interior 17. Accordingly, the inclination angle of the wobble plate 21 becomes large and the discharge capacity of the refrigerant gas is increased. The moment of the wobble plate 21 is equilibrated when the pressure Ps in the suction chamber 6 drops in accordance with the increase of the discharge capacity.

As can be understood from the description of FIGS. 3 and 4, the degree of compression of the compression spring 41 in this invention becomes large when the ratio of the operating distances (La/Lb) becomes large. Therefore, the force of the coil spring 41 against the sleeve 19 opposes the moment of the wobble plate 21 in the direction of the arrow B caused by the force acting upon the piston 16 in the compression stroke, which force operates as the product having the ratio (La/Lb). As a result, the pressure Ps in the suction chamber 6 is kept substantially constant when the moment is equilibrated regardless of the change in the inclination angle of the wobble plate 21. That is, the temperature of the air exhausted from the evaporator into the vehicle interior is also kept at a substantially constant value, i.e., the desired temperature. Moreover, the coil spring 41 in this invention is adjusted so that the biasing force of the coil spring 41 is zero when the inclination angle of the wobble plate 21 is at a maximum. Therefore, the pressure Ps in the suction chamber 6 is kept at the most preferable level just above the pressure which will cause the frost to form on the evaporator, and loss of the returning discharge gas of refrigerant is kept at the least possible amount, which loss amount represents the flow of refrigerant gas out of the discharge chamber 7 and into the suction chamber 6, through the crankcase interior 17. In FIG. 2, the pressure Ps in the suction chamber 6 at the most preferable level is shown by a solid line N. The slant line area above the solid line N is the area in which the temperature of the air exhausted from the evaporator rises so that an occupant of the vehicle feels that the cooling is insufficient. On the other hand, the other slant line area below the solid line N is the area in which frost will form on the evaporator. If the biasing force of the compression spring 41 is not zero at the maximum inclination angle, the pressure Ps in the suction chamber 6 would be as shown by the dash line N' in FIG. 2.

From the foregoing description of the preferred embodiments of the present invention, it will be appreciated that the compression spring opposes the moment of the wobble plate by the differential pressure force between the pressure in the discharge chamber and the pressure in the crankcase interior when the inclination angle of the wobble plate is changed by the change in the pressure in the suction chamber. Therefore, the pressure in the suction chamber at the state wherein the moment is in an equilibrium is kept substantially constant regardless of the inclination angle of the wobble plate. That is, the temperature of the air exhausted from the evaporator remains substantially constant. Accordingly, the inconvenience to the occupant of a vehicle by the rise of the temperature, is eliminated. As the biasing force of the coil spring is zero when the inclination angle of the wobble plate is at a maximum, that is, when the moment of the wobble plate by the differential pressure force between the pressure in the discharge chamber and the pressure in the crankcase interior is very small, the lowering of the performance of the compressor caused by the increased loss of returning discharge refrigerant gas does not occur.

We claim:

1. A wobble plate type compressor including a rear housing having therein a suction chamber for a refrigerant to be compressed and a discharge chamber for discharging the compressed refrigerant, a cylinder block having therein a plurality of cylinder bores with associated reciprocatory pistons disposed therein to take the refrigerant from the suction chamber and to then discharge the refrigerant, after compression, to the discharge chamber, a crankcase connected to the cylinder block and receiving therein a drive shaft and an assembly of non-rotary wobble and rotary drive plates mounted on the drive shaft so as to cause a compressing motion of the reciprocatory pistons, a guide means for permitting inclination of the wobble plate from a plane perpendicular to the drive shaft while preventing any rotation of the wobble plate about the drive shaft, means for maintaining a pressure in said crankcase at a predetermined pressure level having a first passageway between said suction chamber and a crankcase interior and a second closeable passageway between said discharge chamber and said crankcase interior, and a control means for changing the inclination angle of the wobble plate so as to change a discharge capacity within a range to be controlled in accordance with a cooling load, said control means comprising an elastic biasing means for adjusting said inclination angle of said wobble plate, to adjust said discharge capacity in order to keep the pressure in said suction chamber at a substantially constant level regardless of the change in said cooling load, in such a manner as to reduce a decrease in the amount of said inclination angle of said wobble plate caused by said pressure in said crankcase, a pressure in said suction chamber and a pressure in said discharge chamber in accordance with a change in said cooling load, a biasing force of said elastic biasing means being zero when said inclination angle of said wobble plate is at a maximum within said range to be controlled.

2. A wobble plate type compressor according to claim 1, wherein said elastic biasing means comprises a cylindrically coiled helical spring mounted on said drive shaft one end of which abuts against a projection fixedly mounted on said drive shaft and the other end of which abuts against a sleeve slidably mounted on said drive shaft which sleeve is included in said guide means.

* * * * *